United States Patent [19]

Letostak

[11] 4,121,323

[45] Oct. 24, 1978

[54] POCKET OBJECT PROTECTING DEVICE

[75] Inventor: Steve Letostak, South Plainfield, N.J.

[73] Assignee: The Raymond Lee Organization, Inc., New York, N.Y. ; a part interest

[21] Appl. No.: 842,918

[22] Filed: Oct. 17, 1977

[51] Int. Cl.[2] ..... A44B 21/00

[52] U.S. Cl. ..... 24/3 H; 150/47

[58] Field of Search ..... 24/3 R, 3 H, 3 J; 150/47

[56] References Cited

U.S. PATENT DOCUMENTS

| | | | |
|---|---|---|---|
| 1,618,573 | 2/1927 | Cole | 24/3 J |
| 1,735,374 | 11/1929 | Boucher | 24/3 H |
| 3,822,446 | 7/1974 | Silverstein | 24/3 H |
| 3,947,925 | 4/1976 | Hargrave | 24/3 H |

*Primary Examiner*—Henry S. Jaudon

*Attorney, Agent, or Firm*—Daniel Jay Tick

[57] ABSTRACT

A device for securing an object such as a wallet in a pocket of a pair of pants has a body member and a clip attached to an upper portion of the body member. A wedge extends from a side of the body member. The wedge abuts the object in the pocket when the clip is on a belt of the pair of pants to secure the object in the pocket.

4 Claims, 4 Drawing Figures

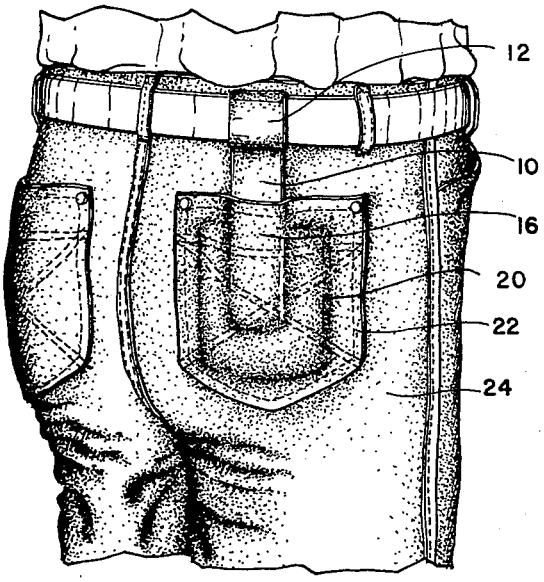
FIG. 1
FIG. 2
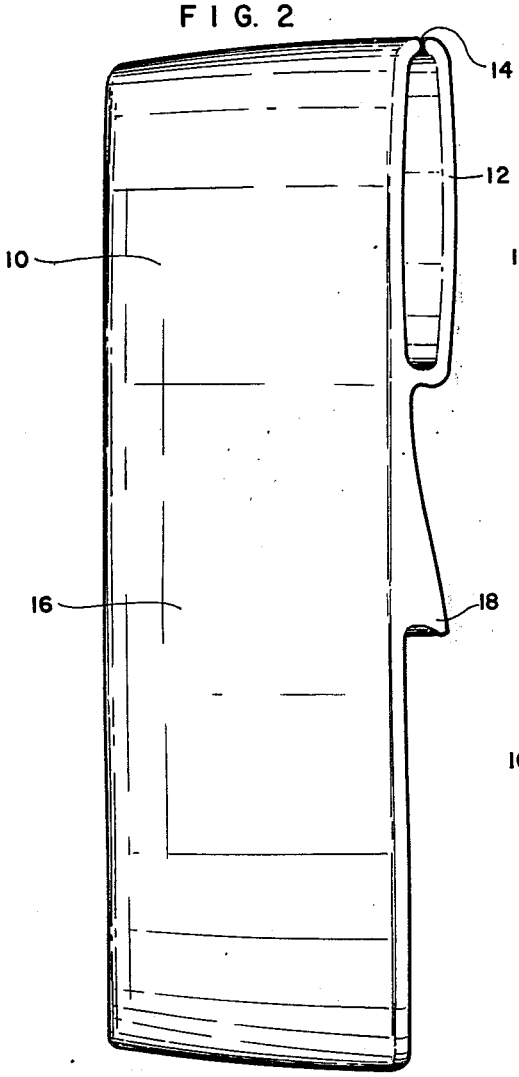
FIG. 3
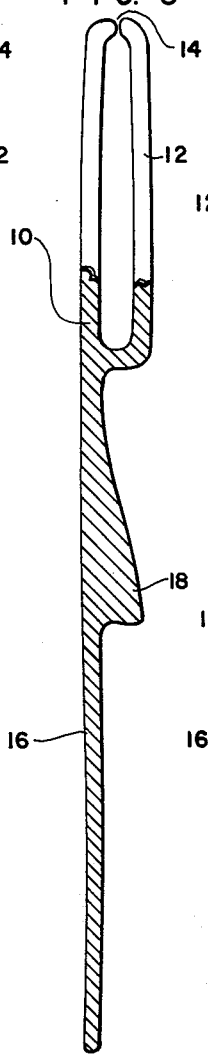
FIG. 4
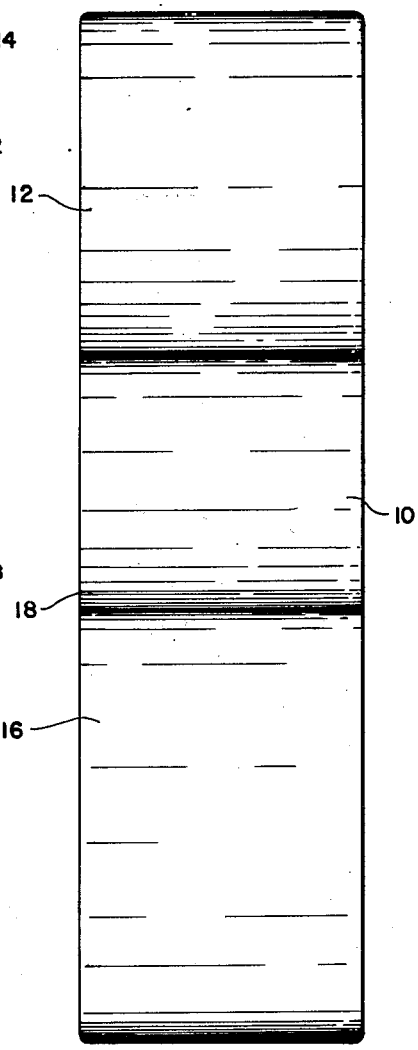

POCKET OBJECT PROTECTING DEVICE

BACKGROUND OF THE INVENTION

The present invention relates to a pocket object protecting device. More particularly, the invention relates to a wallet protecting device.

The pocket object protecting device of the invention is of particular value in preventing objects or items such as, for example, a wallet, placed in a pocket of a pair of pants from working its way out of the pocket and in preventing picking of the contents of the pocket. The device is of particular value to those active in sports where continuous activities may cause objects in the pockets of the pair of pants to slip out. Furthermore, the device of the invention provides increased safety by having a luminous attachment so that the device is visible at all times.

The device of the invention uses a clip which is a slotted loop to engage a belt of the user. The clip is on a body member which extends into the pocket of a pair of pants to protect an object in the pocket by abutting the object with a wedge portion of the body member. The wedge portion rests on the top of the item in the pocket such as, for example, a wallet, when the clip is engaged on the belt.

BRIEF DESCRIPTION OF THE DRAWINGS

In order that the invention may be readily carried into effect, it will now be described with reference to the accompanying drawings, wherein:

FIG. 1 is a view of an embodiment of the pocket object protecting device of the invention in use;

FIG. 2 is a perspective view, on an enlarged scale, of the embodiment of FIG. 1;

FIG. 3 is a side view, partly cut away and partly in section, of the embodiment of FIG. 2; and FIG. 4 is a front view, on an enlarged scale, of the embodiment of FIG. 2.

DETAILED DESCRIPTION OF THE INVENTION

The pocket object protecting device of the invention is for an object or item in a pocket of a pair of pants worn with a belt around the waist.

The device of the invention comprises a body member 10 (FIGS. 1 to 4) having spaced opposite first and second ends. The body member 10 consists of a rigid strip-like member having spaced opposite substantially planar surfaces.

A clip 12 is provided at the first end of the body member, as shown in the FIGS., for releasably clamping the belt of the user, as shown in FIG. 1. The clip comprises a slotted flat loop. A slot 14 (FIGS. 2 and 3) is thus formed through the clip.

A wedge 18 extends from one of the surfaces of the body member 10 intermediate the clip 12 and the second end of said body member. The wedge 18 slopes outward from the surface of the body member 10 as it extends toward the second end of said body member to form a ledge spaced from, and substantially parallel to, said second end.

The lower part 16 (FIGS. 2 to 4) of the body member 10 extends into a pocket 22 of the pair of pants 24 and the ledge of the wedge 18 abuts the object or wallet 20 in said pocket to releasably secure said object in said pocket, as shown in FIG. 1.

Having described a preferred embodiment of my invention, it is understood that various changes can be made without departing from the spirit of my invention, and, I desire to cover by the appended claims all such modifications as fall within the true spirit and scope of my invention.

What I claim and seek to secure by Letters Patent is:

1. A pocket object protecting device for an object in a pocket of a pair of pants worn with a belt around the waist, said device comprising a body member having spaced opposite first and second ends;

clip means at the first end of the body member for releasably clamping a belt of a user; and a wedge extending from said body member intermediate the clip means and the second end of said body member for abutting an object in a pocket of the pair of pants to releasably secure the object in the pocket.

2. A pocket object protecting device as claimed in claim 1, wherein the clip means comprises a slotted loop.

3. A pocket object protecting device as claimed in claim 1, wherein the body member consists of a rigid strip-like member having spaced opposite substantially planar surfaces and said wedge extends from one of said surfaces and slopes outward from said one of said surfaces as it extends toward the second end of said body member to form a ledge spaced from and substantially parallel to said second end.

4. A pocket object protecting device as claimed in claim 1, wherein the object is a wallet.

* * * * *